US011578445B2

(12) United States Patent
Lee et al.

(10) Patent No.: US 11,578,445 B2
(45) **Date of Patent: *Feb. 14, 2023**

(54) WASHING MACHINE AND METHOD FOR CONTROLLING SAME

(71) Applicant: Samsung Electronics Co., Ltd., Suwon-si (KR)

(72) Inventors: Jae Poong Lee, Suwon-si (KR); Seung Hun Choi, Suwon-si (KR); Yo Chul Ha, Suwon-si (KR); Chang Joo Chai, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 114 days.

This patent is subject to a terminal disclaimer.

(21) Appl. No.: 16/995,459

(22) Filed: Aug. 17, 2020

(65) Prior Publication Data

US 2020/0378053 A1 Dec. 3, 2020

Related U.S. Application Data

(63) Continuation of application No. 15/579,894, filed as application No. PCT/KR2016/008793 on Aug. 10, 2016, now Pat. No. 10,745,851.

(30) Foreign Application Priority Data

Aug. 17, 2015 (KR) ..... 10-2015-0115093

(51) Int. Cl.
*D06F 39/14* (2006.01)
*D06F 37/42* (2006.01)
(Continued)

(52) U.S. Cl.
CPC ..... *D06F 33/30* (2020.02); *D06F 33/47* (2020.02); *D06F 37/42* (2013.01); *D06F 39/14* (2013.01);
(Continued)

(58) Field of Classification Search
CPC ..... D06F 37/42; D06F 33/30; D06F 33/47; D06F 39/14; D06F 2103/32;
(Continued)

(56) References Cited

U.S. PATENT DOCUMENTS 2,296,264 A 9/1942 Breckenridge
5,385,037 A 1/1995 Bae
(Continued)

FOREIGN PATENT DOCUMENTS

CL 2017003049 A1 3/2018
CL 2017003050 A1 3/2018
(Continued)

OTHER PUBLICATIONS

The Mexican Institute of Industrial Property, "Office Action" dated Dec. 3, 2021, in connection with Mexican Patent Application No. MX/a/2017/016387, 7 pages.
(Continued)

*Primary Examiner* — Benjamin L Osterhout

(57) ABSTRACT

Provided are a washing machine in which an auxiliary door can be safely and conveniently used and a method of controlling the same. The auxiliary door through which laundry can be additionally put into the washing machine, and the auxiliary door can be safely locked/unlocked. Because an open/closed state of the auxiliary door can be indirectly determined through a locking/unlocking operation of the auxiliary door, even when a door opening/closing detecting device has broken down, the auxiliary door can be safely used. The auxiliary door is unlocked by default and conditions on which the auxiliary door is locked for safety if necessary, are minimized during an operation of the washing machine so that use convenience of the auxiliary door can be enhanced, and a locked state of the auxiliary
(Continued)

door is maintained according to the amount of laundry so that the laundry can be safely put into the washing machine.

17 Claims, 11 Drawing Sheets

(51) Int. Cl.

| | |
|---|---|
| ***D06F 33/00*** | (2020.01) |
| ***D06F 33/30*** | (2020.01) |
| ***D06F 33/47*** | (2020.01) |
| *D06F 103/04* | (2020.01) |
| *D06F 103/16* | (2020.01) |
| *D06F 103/18* | (2020.01) |
| *D06F 103/24* | (2020.01) |
| *D06F 103/32* | (2020.01) |
| *D06F 103/40* | (2020.01) |
| *D06F 105/44* | (2020.01) |
| *D06F 34/14* | (2020.01) |

(52) U.S. Cl.
CPC ..... *D06F 34/14* (2020.02); *D06F 2103/04* (2020.02); *D06F 2103/16* (2020.02); *D06F 2103/18* (2020.02); *D06F 2103/24* (2020.02); *D06F 2103/32* (2020.02); *D06F 2103/40* (2020.02); *D06F 2105/44* (2020.02)

(58) Field of Classification Search
CPC .. D06F 2103/04; D06F 34/14; D06F 2103/16; D06F 2103/24; D06F 2103/18; D06F 2105/44; D06F 2103/40
See application file for complete search history.

(56) References Cited

U.S. PATENT DOCUMENTS

| | | | | |
|---|---|---|---|---|
| 5,546,772 | A | 8/1996 | Merlin et al. | |
| 10,745,851 | B2 * | 8/2020 | Lee | D06F 39/14 |
| 2011/0041567 | A1 | 2/2011 | Ko et al. | |
| 2011/0062839 | A1 | 3/2011 | Kim et al. | |
| 2011/0083476 | A1 | 4/2011 | Yang | |
| 2015/0361690 | A1 | 12/2015 | Hintz et al. | |
| 2016/0369445 | A1 | 12/2016 | Kim et al. | |
| 2018/0135231 | A1 | 5/2018 | Park et al. | |
| 2018/0237971 | A1 | 8/2018 | Kim et al. | |
| 2018/0340286 | A1 | 11/2018 | Kim et al. | |

FOREIGN PATENT DOCUMENTS

| | | | |
|---|---|---|---|
| CL | 2017003051 | A1 | 3/2018 |
| DE | 2244751 | A1 | 3/1974 |
| EP | 0808935 | A1 | 11/1997 |
| EP | 1389643 | A2 | 2/2004 |
| EP | 1662036 | A2 | 5/2006 |
| EP | 3287557 | B1 | 6/2021 |
| JP | 09-201483 | A | 8/1997 |
| KR | 10-1994-0011719 | A | 6/1994 |
| KR | 10-1995-0000976 | A | 1/1995 |
| KR | 10-1996-0023414 | A | 7/1996 |
| KR | 10-0144268 | B1 | 10/1998 |
| KR | 10-2004-0015480 | A | 2/2004 |
| KR | 10-0583201 | B1 | 5/2006 |
| KR | 10-2006-0059744 | A | 6/2006 |
| WO | 2011/063486 | A1 | 6/2011 |

OTHER PUBLICATIONS

Office Action dated Jan. 6, 2021 in connection with Chinese Patent Application No. 201680036697.5, 11 pages.
Office Action dated Aug. 28, 2020 in connection with Chinese Patent Application No. 201680036697.5, 13 pages.
Korean Intellectual Property Office, "Notice of Preliminary Rejection" dated Oct. 12, 2021, in connection with Korean Patent Application No. 10-2015-0115093, 22 pages.
Office Action dated Sep. 7, 2021, from the Mexican Institute of Industrial Property, in connection with Mexico Patent Application No. MX/a/2017/016387, 6 pages.
International Search Report dated Oct. 26, 2016 in connection with International Patent Application No. PCT/KR2016/008793.
Written Opinion dated Oct. 26, 2016 in connection with International Patent Application No. PCT/KR2016/008793.
European Patent Office, "Supplementary European Search Report," Application No. EP 16837259.7, dated May 2, 2018, 10 pages.
Australian Government IP Australia, "Examination report No. 1 for standard patent application," Application No. AU 2016307570, dated May 31, 2018, 3 pages.
IP Australia, "Notice of acceptance for patent application," Application No. AU 2016307570, dated Oct. 9, 2018, 3 pages.
Office Action dated Jan. 14, 2019 in connection with Chile Patent Application No. 201703048, 12 pages.
Chilean Patent and Trademark Office—INAPI, "Examiner's Report on Invention Patent Application," Application No. CL 201703048, dated Sep. 16, 2019, 24 pages.
Examination report in connection with Australian Application No. 2019200385 dated Dec. 19, 2019, 3 pages.
Socialist Republic of Vietnam, "Result of substantive examination" dated Mar. 31, 2021, in connection with Vietnamese Patent Application No. 1-2018-00703, 4 pages.
Korean Intellectual Property Office, "Decision of Rejection," dated Apr. 26, 2022, in connection with Korean Patent Application No. 10-2015-0115093, 6 pages.
Brazilian National Institute of Industrial Property, "The Second Office Action" dated Apr. 20, 2022, in connection with Brazilian Patent Application No. BR1120170271699, 5 pages.
Office Action dated Aug. 3, 2022 in connection with Brazil Patent Application No. BR112017027169-9, 5 pages.
Notice of Patent Allowance dated Aug. 24, 2022 in connection with Korean Patent Application No. 10-2015-0115093, 4 pages.

* cited by examiner

WASHING MACHINE AND METHOD FOR CONTROLLING SAME

CROSS-REFERENCE TO RELATED APPLICATIONS

The present application is a continuation of U.S. patent application Ser. No. 15/579,894 filed on Dec. 5, 2017, which is a 371 of International Patent Application No. PCT/KR2016/008793 filed on Aug. 10, 2016, which claims priority to Korean Patent Application No. 10-2015-00115093 filed on Aug. 17, 2015, the disclosures of which are herein incorporated by reference in their entirety.

BACKGROUND

1. Field

The present invention relates to a washing machine having an auxiliary door and a method of controlling the same, and more particularly, to a washing machine in which an auxiliary door can be safely and conveniently used, and a method of controlling the same.

2. Description of Related Art

In general, washing machines, for example, drum washing machines, are apparatuses which include a tub for storing water (washing water or rinsing water), a drum rotatably installed inside the tub and accommodating laundry and a motor that generates a driving force for rotating the drum and in which, when the drum is rotated, the laundry inside the drum ascends or descends along inner walls of the drum so that the contaminated laundry can be washed.

A laundry port through which the laundry can be put into or taken out of the inside of the drum, is formed in the washing machine, and a door is disposed to open/close the laundry port. Thus, a user opens the door to take or put the laundry out of or into the drum.

When an operation of the washing machine starts to perform, the door is kept in a locked state. Thus, when the user wants to additionally put the laundry, the user needs to open the door. In order to open the door during the operation of the washing machine, it has to be waited until a washing cycle is finished, or supplied water has to be drained. In this way, it is not easy to additionally put the laundry during the operation of the washing machine.

SUMMARY

The present invention is directed to providing a washing machine which includes an auxiliary door through which laundry can be additionally put into the washing machine and which can be safely locked/unlocked, and a method of controlling the washing machine.

The present invention is also directed to providing a washing machine in which an open/closed state of an auxiliary door can be determined by performing a locking/unlocking operation of the auxiliary door, and a method of controlling the washing machine.

The present invention is also directed to providing a washing machine in which an auxiliary door is unlocked by default and conditions on which the auxiliary door is locked for safety if necessary, are minimized during an operation of the washing machine so that use convenience of the auxiliary door can be enhanced, and a method of controlling the washing machine.

The present invention is also directed to providing a washing machine in which a locked state of an auxiliary door is maintained according to the amount of laundry (the weight of the laundry) so that the laundry can be safely put into the washing machine, and a method of controlling the washing machine.

The present invention is also directed to providing a washing machine in which, when an auxiliary door is opened during an operation of the washing machine, the weight of laundry can be detected again and a washing performance of the added laundry can be guaranteed through additional supply of water and time increase, and a method of controlling the washing machine.

One aspect of the present invention provides a washing machine including: a main body configured to constitute an exterior of the washing machine and having a laundry port therein; a main door installed in the main body to open and close the laundry port; an auxiliary door installed in the main door and capable of being opened and closed separately from the main door; a door opening and closing sensor detecting opening and closing of the auxiliary door; a locking device configured to lock or unlock the auxiliary door in a state in which the auxiliary door is closed; and a controller configured to unlock the auxiliary door when a locking time of the auxiliary door is counted and a predetermined time elapses.

The locking device may include: a locking protrusion installed to be insertable into a locking groove formed in the auxiliary door and locking or unlocking the auxiliary door; and a barrier that moves depending on opening and closing of the auxiliary door so as to operate the locking protrusion.

The barrier may operate the locking protrusion only in a state in which the auxiliary door is closed, so that locking of the auxiliary door is performed.

The washing machine may further include: a tub installed inside the main body and configured to accommodate water; and a drum rotatably installed inside the tub and configured to accommodate laundry, wherein the controller may maintain the auxiliary door in an unlocked state during an operation of the washing machine, and when locking conditions of the auxiliary door are detected by a detector, the controller may control a locking operation of the auxiliary door.

The detector may detect a temperature of water accommodated in the tub, and the controller may attempt to perform a locking operation of the auxiliary door when the detected temperature of water is higher than a first set temperature.

The detector may detect an air temperature inside the tub, and the controller may attempt to perform a locking operation of the auxiliary door when the detected air temperature is higher than a second set temperature.

The detector may detect a weight of the laundry accommodated in the drum, and the controller may attempt to perform a locking operation of the auxiliary door when the detected weight of the laundry is a predetermined weight or more.

The detector may detect a level of water accommodated in the tub, and the controller may attempt to perform a locking operation of the auxiliary door when the detected level is an overflow level.

The detector may detect dehydration revolutions per minute (RPM) of the drum, and the controller may attempt to perform a locking operation of the auxiliary door when the detected dehydration RPM is higher than a set RPM.

Another aspect of the present invention provides a method of controlling a washing machine including a main body having a laundry port therein, a tub installed inside the main body and accommodating water, a drum rotatably installed inside the tube, a main door installed in the main body to open and close the laundry port, and an auxiliary door installed in the main door and capable of being opened and closed separately from the main door, the method including: determining whether the auxiliary door is closed; when the auxiliary door is closed, locking the auxiliary door; and when a locking time of the auxiliary door is counted and a predetermined time elapses, unlocking the auxiliary door.

The locking of the auxiliary door may include: moving a barrier provided in a locking device due to a locking groove formed in the auxiliary door when the auxiliary door is closed; protruding a locking protrusion provided in the locking device outwards according to the movement of the barrier; and inserting the protruding locking protrusion into the locking groove so that the auxiliary door is locked.

The method may further include: determining whether the auxiliary door is locked; and controlling the washing machine to start an operation of the washing machine when the auxiliary door is locked.

The method may further include: determining whether locking conditions of the auxiliary door are detected while the washing machine operates in a state in which the auxiliary door is unlocked; and when the locking conditions of the auxiliary door are detected, controlling a locking operation of the auxiliary door.

According to a proposed washing machine and a method of controlling the same, an auxiliary door through which laundry can be additionally put into the washing machine, is provided, and the auxiliary door can be safely locked/unlocked. Because an open/closed state of the auxiliary door can be indirectly determined through a locking/unlocking operation of the auxiliary door, even when a door opening/closing detecting device has broken down, the auxiliary door can be safely used.

In addition, the auxiliary door is unlocked by default and conditions on which the auxiliary door is locked for safety if necessary, are minimized during an operation of the washing machine so that use convenience of the auxiliary door can be enhanced, and a locked state of the auxiliary door is maintained according to the amount of laundry (the weight of the laundry) so that the laundry can be safely put into the washing machine.

Furthermore, when the auxiliary door is opened during an operation of the washing machine, the weight of the laundry can be detected again and a washing performance of the added laundry can be guaranteed through additional supply of water and time increase so that a user's reliance on a product can be enhanced.

DETAILED DESCRIPTION

Figure 1:
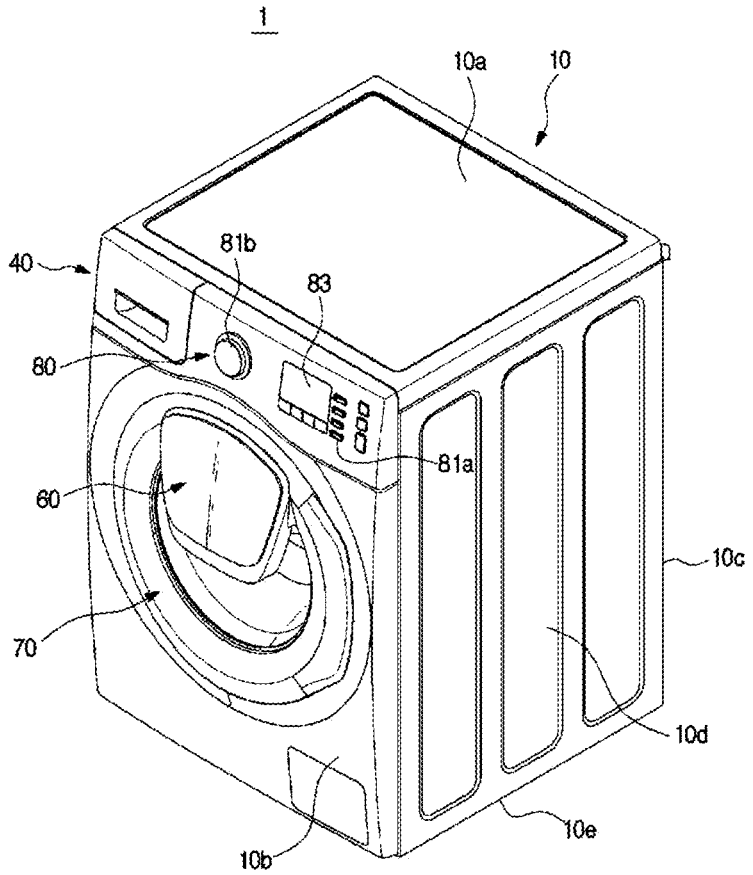
FIG. 1 is a perspective view of an exterior of a washing machine according to an embodiment of the present invention.

Embodiments described in the present specification and configuration shown in the drawings are just exemplary embodiments of the invention, and there may be various modifications that may replace the embodiments of the present specification and the drawings at the time of filing the present application.

Like reference numerals or symbols in each of the drawings of the present specification represent components or elements that perform materially the same functions.

The terms used in the present specification are merely used to describe particular embodiments, and are not intended to limit the present invention. An expression used in the singular encompasses the expression of the plural, unless it has a clearly different meaning in the context. In the present specification, it is to be understood that the terms such as "including" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

It will be understood that although the terms first and second are used herein to describe various elements, these elements should not be limited by these terms. These terms are only used to distinguish one element from another element. Thus, a first element discussed below could be termed a second element, and similarly, a second element may be termed a first element without departing from the teachings of this disclosure. As used herein, the term "and/or" includes any and all combinations of one or more of the associated listed items.

Hereinafter, embodiments of the present invention will be described in detail with reference to the attached drawings.

Figure 2:
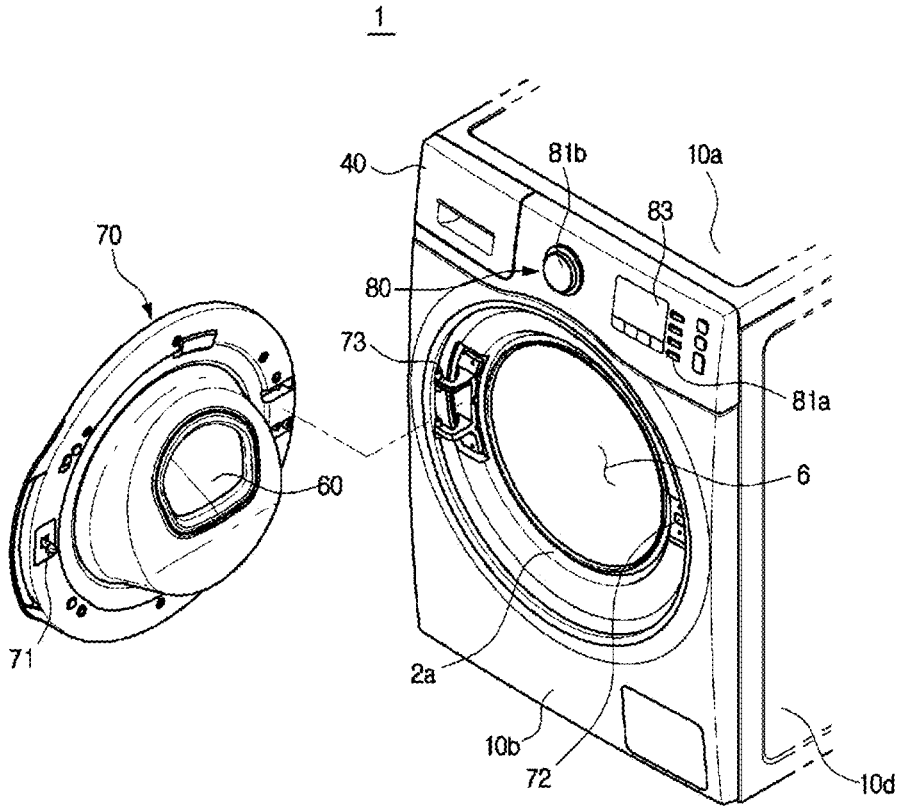
FIG. 2 is a perspective view of a state in which a main door of the washing machine according to an embodiment of the present invention is opened.
Figure 3:
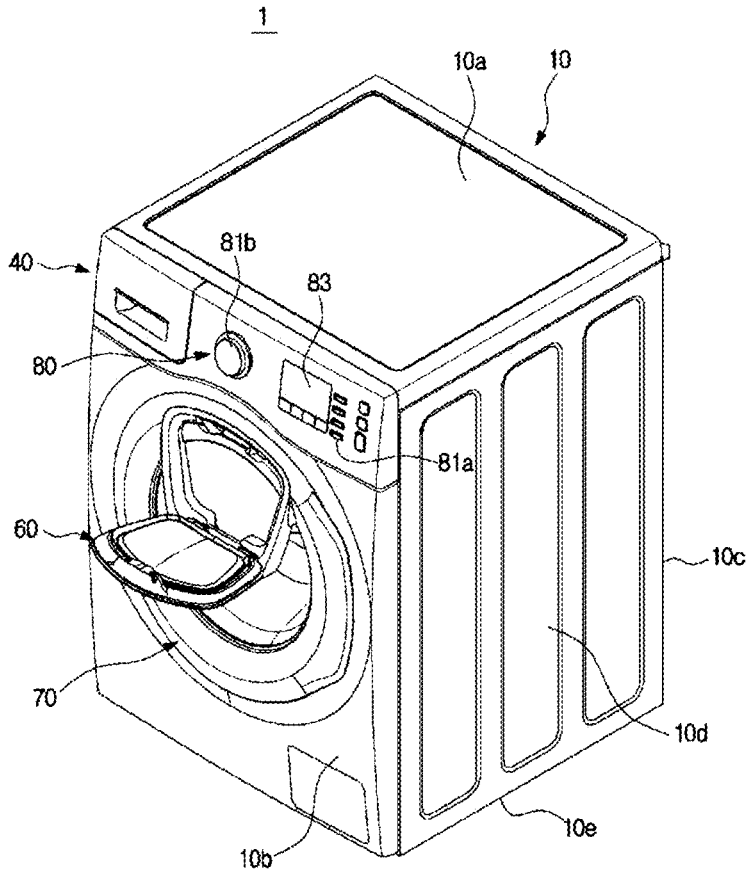
FIG. 3 is a perspective view of a state in which an auxiliary door of the washing machine according to an embodiment of the present invention is opened.
Figure 4:
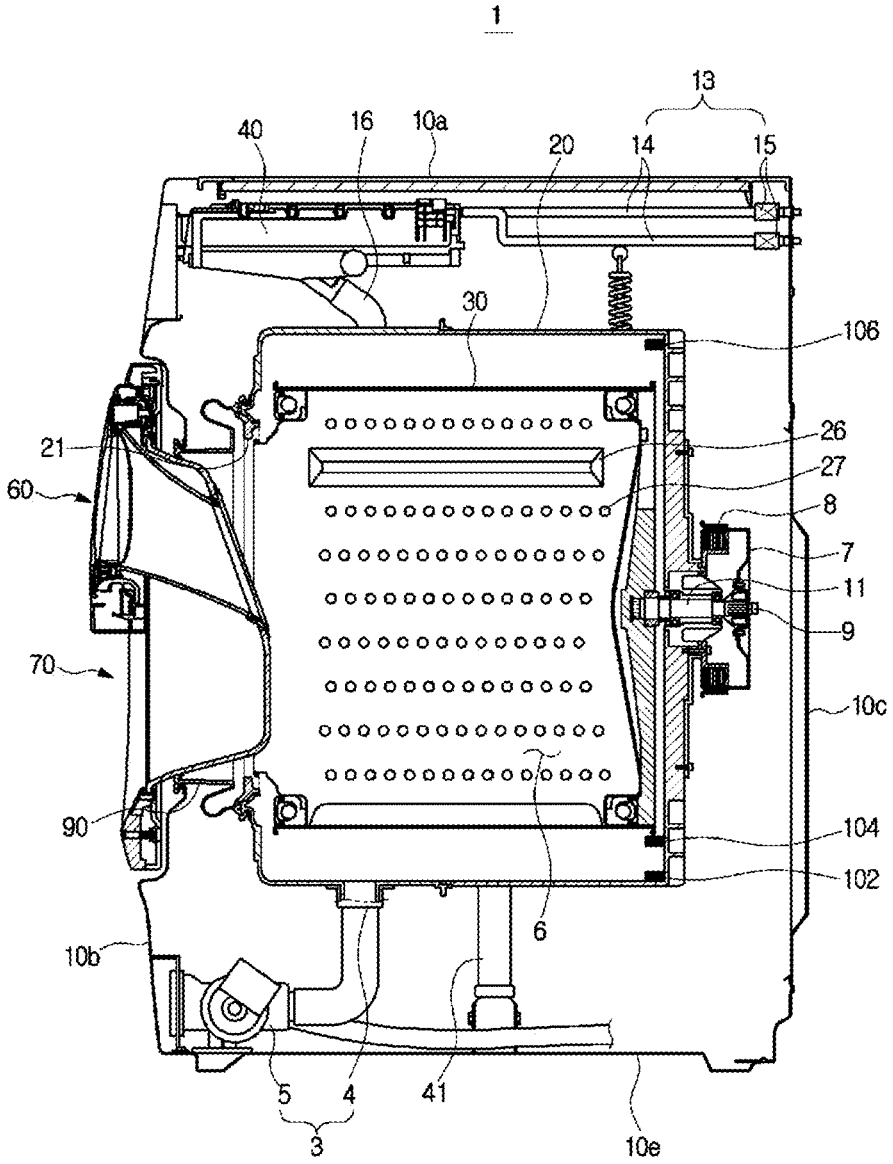
FIG. 4 is a cross-sectional view of a configuration of the washing machine according to an embodiment of the present invention.

FIG. 1 is a perspective view of an exterior of a washing machine according to an embodiment of the present invention, FIG. 2 is a perspective view of a state in which a main door of the washing machine according to an embodiment of the present invention is opened, FIG. 3 is a perspective view of a state in which an auxiliary door of the washing machine according to an embodiment of the present invention is opened, and FIG. 4 is a cross-sectional view of a configuration of the washing machine according to an embodiment of the present invention.

Referring to FIGS. 1 through 4, a washing machine 1 includes a main body 10 that has an approximately box shape and forms an exterior of the washing machine 1, a tub 20 that accommodates water (washing water or rinsing water) to be used in a washing or rinsing cycle, a drum 30 that accommodates laundry, and a motor 7 that rotates the drum 30.

A control panel 80 on which various buttons for controlling the washing machine 1 and a display are disposed, is disposed on a top of a front surface of the main body 10, and input units 81*a* and 81*b* through which user's manipulation instructions are input to the washing machine 1 so as to control an operation of the washing machine 1, and a display unit 83 for displaying an operating state of the washing machine 1 and the user's manipulation state are disposed on the control panel 80.

The input units 81*a* and 81*b* may receive the user's instructions relating to the operation of the washing machine 1, such as a washing course, the number of times being rinsed, a dehydration time, a drying time, operation and pause, and the like, and employ a pressing button 81*a* or a rotating button 81*b*.

The display unit 83 displays information about the operation of the washing machine 1, such as the amount of washing water, a cycle performed by the washing machine 1, a remaining time until washing is finished, and the like. The display unit 83 may be implemented with a liquid crystal display (LCD) panel, a light-emitting diode (LED) panel, an organic light emitting diode (OLED) panel, or the like.

The washing machine 1 according to an embodiment of the present invention includes the input units 81*a* and 81*b* and the display unit 83 separately. However, embodiments of the present invention are not limited thereto, and the input units 81*a* and 81*b* and the display unit 83 may be integrally configured by employing a touch screen panel (TSP) through which manipulation instructions are input from a user and on which operation information corresponding to the input manipulation instructions is displayed.

The TSP may include a display for displaying operation information and control instructions to be input by the user, a touch panel for detecting coordinates that the user's body part touches, and a touch screen controller for determining the control instructions input by the user based on the touch coordinates detected by the touch panel.

The touch screen controller may compare the user's touch coordinates detected using the touch panel with coordinates of the control instructions displayed using the display unit 83, thereby recognizing the control instructions input by the user.

Also, the main body 10 includes frames 10*a*, 10*b*, 10*c*, and 10*d*. The frames 10*a*, 10*b*, 10*c*, and 10*d* include a top frame 10*a* that constitutes a top surface of the main body 10, a front frame 10*b* and a rear frame 10*c* that constitute front and rear surfaces of the main body 10, a side frame 10*d* and a bottom frame 10*e* that connect the front frame 10*b* to the rear frame 10*c* and constitute sides and a bottom surface of the main body 10.

A laundry port 2*a* through which laundry can be put into the inside of the drum 30, is formed in the front frame 10*b* of the main body 10. The laundry port 2*a* is opened/closed by a main door 70 installed at the front frame 10*b* of the main body 10.

A diaphragm 90 may connect the main body 10 to the tub 20. The diaphragm 90 may be disposed between the laundry port 2*a* of the front frame 10*b* and an opening 21 of the tub 20, may form a path from the laundry port 2*a* of the front frame 10*b* to the opening 21 of the tub 20, and may reduce vibration transferred to the front frame 10*b* when the drum 30 is rotated. Also, a part of the diaphragm 90 is disposed between the main door 70 and the front frame 10*b* so as to prevent water in the tub 20 from leaking to an outside of the main body 10.

The diaphragm 90 may be formed of an injection molding material with thermoplastic elastomer. Because thermoplastic elastomer has elasticity at room temperature, like rubber, the diaphragm 90 formed of thermoplastic elastomer may effectively reduce vibration transferred from the tub 20 to the front frame 10*b* of the main body 10.

A spring 17 may be disposed between the tub 20 and the main body 10 so as to support the tub 20 at an upper side. The spring 17 reduces vibration and noise generated due to the tub 20 that moves by elasticity.

A water supply unit 13 for supplying water into the tub 20 and a detergent supply unit 40 for supplying a detergent and a fabric softener into the tub 20 are installed at an upper portion of the tub 20.

The water supply unit 13 includes a water supply pipe 14 that connects an external water supply pipe to the detergent supply unit 40 so as to supply water (washing water or rinsing water) into the tub 20, and a water supply valve 15 that opens/closes the water supply pipe 14 to control water supply of hot or cold water.

The detergent supply unit 40 is connected to the tub 20 via a connection pipe 16 connected to a lower portion thereof. The detergent and the fabric softener inside the detergent supply unit 40 pass through the detergent supply unit 40 and are supplied into the tub 20 together with water using the water supply unit 13 connected to the tub 20. This configuration enables water supplied into the tub 20 to pass through the detergent supply unit 40 and the detergent to be supplied into the tub 20 together with the water.

The tub 20 is supported by a damper 41. The damper 41 connects an inside bottom surface of the main body 10 to an outer surface of the tub 20. Also, the damper 41 may be disposed at an upper side or left and right sides of the main body 10 in addition to the inside bottom surface of the main body 10 so as to support the tub 20. The damper 41 or the spring 17 may reduce vibration and impact generated due to vertical movement of the tub 20 in upper and lower portions of the tub 20.

The tub 20 may be supported by at least one damper 41.

A plurality of through holes 27 through which water (washing water or rinsing water) flows, are formed in the circumference of the drum 30. A plurality of lifters 26 are installed at an inner circumferential surface of the drum 30 so that, when the drum 30 is rotated, the laundry can be ascended or descended.

A motor 7 for generating a driving force used to rotate the drum 30 is installed at a rear surface of the tub 20. Generally, the motor 7 is an universal motor including a field coil and an armature, or a brushless direct (BLDC) motor including a permanent magnet and an electric magnet, and any motor that may be applied to the drum 30 may be used. In addition, the motor 7 may be configured in a belt manner.

A driving shaft 11 for transferring the driving force of the motor 7 is installed between the drum 30 and the motor 7.

One end of the driving shaft 11 is connected to a rear plate of the drum 30, and the other end of the driving shaft 11 extends toward an outside of a rear wall of the tub 20. When the motor 7 drives the driving shaft 11, the drum 30 connected to the driving shaft 11 is rotated around the driving shaft 11.

A bearing housing 8 is installed at the rear wall of the tub 20 so as to rotatably support the driving shaft 11. The bearing housing 8 may be formed of an aluminum alloy and may be inserted into the rear wall of the tub 20 when the tub 20 is injection molded. Bearings 9 are installed between the bearing housing 8 and the driving shaft 11 so that the driving shaft 11 can be smoothly rotated.

A drainage unit 3 for discharging water inside the tub 20 to the outside of the main body 10 may be disposed at a lower portion of the tub 20. The drainage unit 3 may include a drainage pipe 4 that guides water in the tub 20 toward the outside of the main body 10, and a drainage pump 5 that pumps water in the tub 20. In an embodiment of the present invention, the drainage pump 5 is installed so as to discharge water. However, embodiments of the present invention are not limited thereto, and a drainage motor or drainage valve may be installed.

The washing machine 1 according to an embodiment of the present invention may further include an auxiliary door 60 to be combined with the main door 70 so that the laundry can be additionally put through the auxiliary door 60 without opening the main door 70. One side of the auxiliary door 60 may be hinge-coupled to the main door 70.

The main door 70 and the auxiliary door 60 may be independently opened/closed.

That is, as illustrated in FIG. 2, only the main door 70 may be opened, and as illustrated in FIG. 3, only the auxiliary door 60 may also be opened.

The main door 70 may be provided to be rotatable in a horizontal direction, and the auxiliary door 60 may be provided to be rotatable in a vertical direction. That is, a rotation shaft of the main door 70 and a rotation shaft of the auxiliary door 60 may be orthogonal to each other.

However, unlike this, the main door 70 and the auxiliary door 60 may be rotated in the same direction. That is, the rotation shaft of the main door 70 and the rotation shaft of the auxiliary door 60 may be parallel to each other. Furthermore, the rotation shaft of the main door 70 and the rotation shaft of the auxiliary door 60 may be disposed on the same line.

The auxiliary door 60 is disposed at an approximately upper portion of the main door 70. That is, when the auxiliary door 60 is opened/closed during an operation of the washing machine 1, the auxiliary door 60 needs to be disposed in a higher position than the level of water stored in the tub 20 so that water (washing water or rinsing water) in the tub 20 can be prevented from overflowing.

In addition, when a left side or right side of the auxiliary door 60 is hinge-coupled to the main door 70, the auxiliary door 60 may be opened/closed in the horizontal direction. When an upper side or a lower side of the auxiliary door 60 is hinge-coupled to the main door 70, the auxiliary door 60 may be opened/closed in the vertical direction. Preferably, the lower side of the auxiliary door 60 may be hinge-coupled to the main door 70 so that the auxiliary door 60 can be opened/closed downwards.

Also, preferably, the auxiliary door 60 is formed of a material having an insulating property or a heat-resisting property. Hot wind exists in the inside of the main body 10 during a washing or dehydration operation. This hot wind is transferred to the auxiliary door 60 so that the temperature of the auxiliary door 60 may rise. When the user touches the auxiliary door 60 having a rising temperature, the user can feel unpleasant. Thus, in order to prevent this problem, the auxiliary door 60 may be formed of a material having an insulating property. Through this configuration, heat of air that flows in a washing space 6 inside the auxiliary door 60 may not be transferred to the outside of the auxiliary door 60.

A locking device 71 may be formed at one side of the main door 70.

The locking device 71 of the main door 70 may be installed to be detachable from a main locking device 72 installed in the front frame 10*b* of the main body 10. That is, when the main door 70 is closed, the locking device 71 is inserted into the main locking device 72 of the front frame 10*b*, and the main door 70 is maintained in a locked state, and when the main door 70 is opened, the locking device 71 is detached from the main locking device 72 of the front frame 10*b*, and the main door 70 is maintained in an unlocked state.

A door pivoting unit 73 is formed at the other side of the front frame 10*b* having the main locking device 72 formed therein. The door pivoting unit 73 is hinge-coupled to one side of the main door 70, and the main door 70 is pivoted with respect to the main body 10, and the laundry port 2*a* can be opened/closed.

Figure 5:
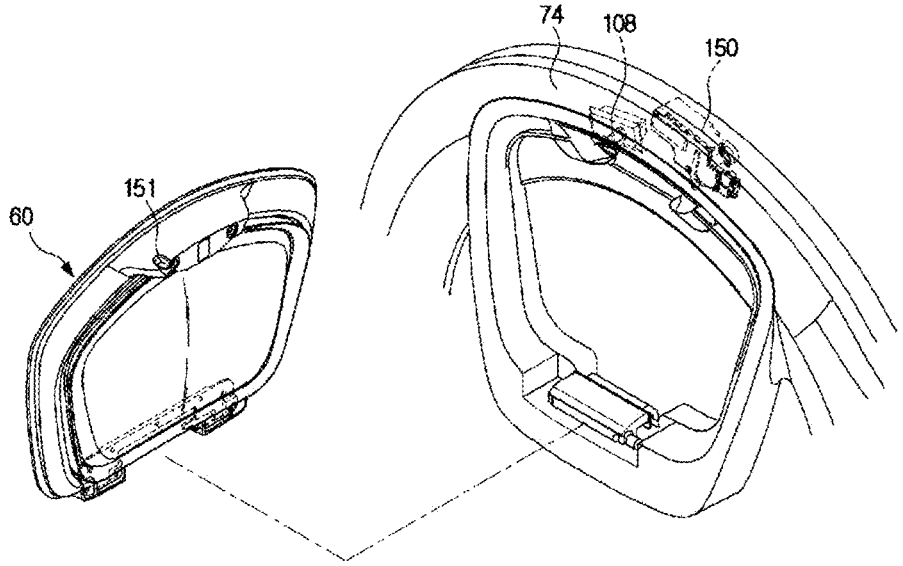
FIG. 5 is an exploded view of the auxiliary door at a door assembly according to an embodiment of the present invention.
Figure 6:
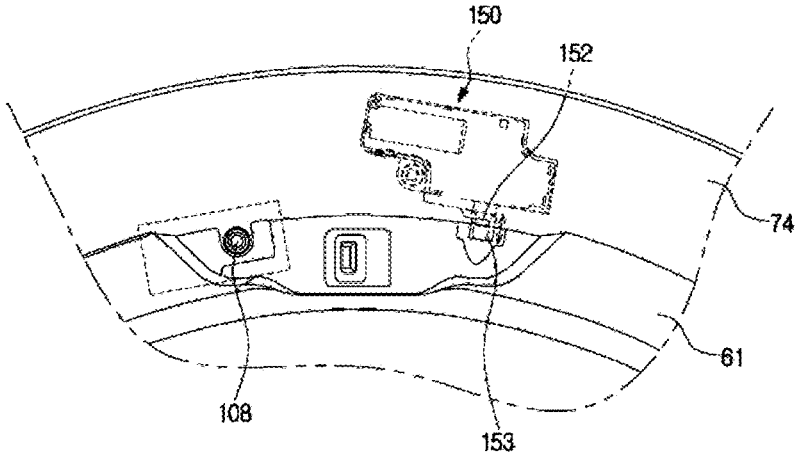
FIG. 6 is a view of a locking device of the auxiliary door and a door opening/closing sensor according to an embodiment of the present invention.
Figure 7:
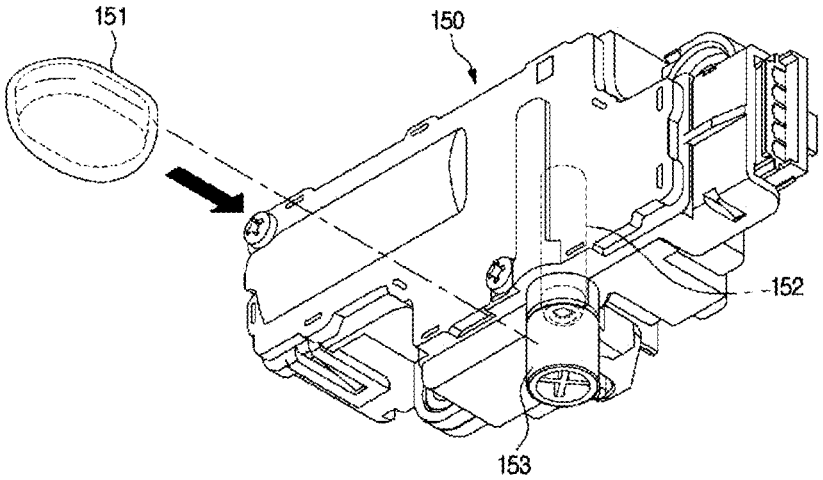
FIG. 7 is a view of an operating state of an auxiliary locking device illustrated in FIG. 6 in a state in which the auxiliary door is opened.
Figure 8:
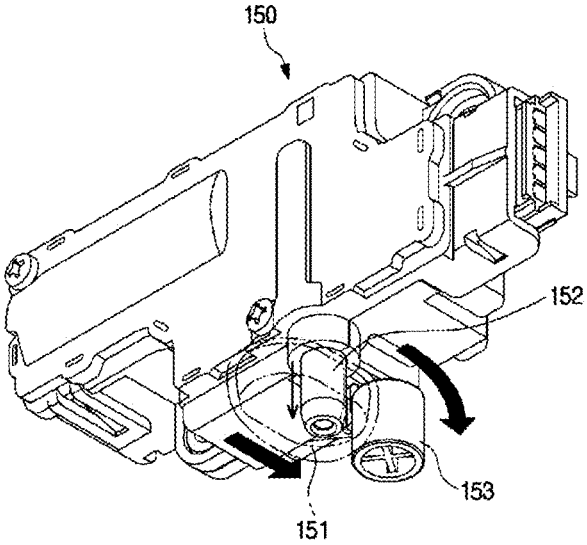
FIG. 8 is a view of an operating state of the auxiliary locking device illustrated in FIG. 6 in a state in which the auxiliary door is closed.

FIG. 5 is an exploded view of the auxiliary door at a door assembly according to an embodiment of the present invention, FIG. 6 is a view of a locking device of the auxiliary door and a door opening/closing sensor according to an embodiment of the present invention, FIG. 7 is a view of an operating state of an auxiliary locking device illustrated in FIG. 6 in a state in which the auxiliary door is opened, and FIG. 8 is a view of an operating state of the auxiliary locking device illustrated in FIG. 6 in a state in which the auxiliary door is closed.

Referring to FIGS. 5 and 6, a locking groove 151 is formed in the auxiliary door 60 so as to lock or unlock the auxiliary door 60.

The locking groove 151 formed in the auxiliary door 60 may be inserted into an auxiliary locking device 150 installed in a body 74 of the main door 70.

The auxiliary locking device 150 includes a locking protrusion 152 formed to be insertable into the locking groove 151 formed in the auxiliary door 60, and a barrier 153 that prevents protrusion of the locking protrusion 152 depending on whether the auxiliary door 60 is opened/closed.

The barrier 153 protrudes toward the front of a body 61 of the auxiliary door 60 in a state in which the auxiliary door 60 is opened, and the barrier 153 is pressed by the locking groove 151 formed in the auxiliary door 60 and moves downwards in a state in which the auxiliary door 60 is closed, to be inserted into the inside of the body 61 of the auxiliary door 60.

That is, in a state in which the auxiliary door 60 is opened, the barrier 153 protrudes toward the front of the body 61 of the auxiliary door 60 to prevent the locking protrusion 152 from protruding so that the locking protrusion 152 is not inserted into the locking groove 151 and the auxiliary door 60 is in an unlocked state (see FIG. 7).

Meanwhile, in a state in which the auxiliary door 60 is closed, the barrier 153 is pressed by the locking groove 151 and moves downwards and thus is inserted into the body 61 of the auxiliary door 60 so that the locking protrusion 152 protrudes. Thus, the protruding locking protrusion 152 is inserted into the locking groove 151, and the auxiliary door 60 is in a locked state (see FIG. 8).

One side of the auxiliary door 60 hinge-coupled to the main door 70 may face the other side of the auxiliary door 60 having the locking groove 151 formed therein. That is, when the left side of the auxiliary door 60 is hinge-coupled to the main door 70, the locking groove 151 may be formed in the right side of the auxiliary door 60. When the right side of the auxiliary door 60 is hinge-coupled to the main door 70, the locking groove 151 may be formed in the left side of the auxiliary door 60. When an upper side of the auxiliary door 60 is hinge-coupled to the main door 70, the locking groove 151 may be formed in a lower side of the auxiliary door 60. When the lower side of the auxiliary door 60 is hinge-coupled to the main door 70, the locking groove 151 may be formed in the upper side of the auxiliary door 60.

The auxiliary door 60 is in an unlocked state by default during the operation of the washing machine 1, and when locking conditions of the auxiliary door 60 are generated for safety if necessary, the auxiliary door 60 is maintained in a locked state.

Whether the auxiliary door 60 is opened/closed may be determined by a door opening/closing sensor 108. The door opening/closing sensor 108 may be installed at one side of the body 74 of the main door 70 and may include a reed switch or a micro switch. The reed switch or micro switch protrudes in a state in which the auxiliary door 60 is opened, and the reed switch or micro switch is pressed by the auxiliary door 60 in a state in which the auxiliary door 60 is closed. A controller 110 (see FIG. 9) analyzes a signal output from the reed switch or micro switch to determine whether the auxiliary door 60 is opened/closed, and controls a locking operation of the auxiliary door 60 according to the result of determination.

In addition, whether the auxiliary door 60 is opened/closed may be determined by an optical sensor (not shown). The optical sensor may include a light-emitting unit (not shown) in which a light-irradiating direction varies according to movement of the auxiliary door 60, and a light-receiving unit (not shown) that receives light irradiated by the light-emitting unit and outputs a signal having a magnitude corresponding to the amount of the received light. The controller 110 (see FIG. 5) analyzes the signal output by the light-receiving unit, determines whether the auxiliary door 60 is opened/closed, and controls a locking operation of the auxiliary door 60 according to the result of determination.

A method of determining whether the auxiliary door 60 is opened/closed, is not limited to the above example but may be modified in various ways.

The door opening/closing sensor 108 may operate normally and determine that the auxiliary door 60 is in a closed state, and the auxiliary locking device 150 may forcibly lock the auxiliary door 60 by inserting the locking protrusion 152 into the locking groove 151 so that the auxiliary door 60 can be maintained in a locked state.

Even when the door opening/closing sensor 108 has broken down, when the locking protrusion 152 of the auxiliary locking device 150 is inserted into the locking groove 151, it may be indirectly determined that the auxiliary door 60 is in a closed state depending on whether the auxiliary door 60 is successfully locked or not so that it is checked whether the auxiliary locking device 150 is locked or not and subsequent processes of the washing machine 1 are preformed and thus a safe operation of the washing machine 1 can be guaranteed.

That is, the door opening/closing sensor 108 and the auxiliary locking device 150 are configured to determine whether the auxiliary door 60 is opened/closed but are not limited thereto.

In addition, in the washing machine 1 according to an embodiment of the present invention, a water level sensor 102 that detects a frequency varying according to a water level so as to detect the amount (level) of water in the tub 20 is installed inside a lower side of the tub 20, and a first temperature sensor 104 that detects a temperature of water (water temperature Tw) inside the tub 20 is installed in a predetermined position in which water between the tub 20 and the drum 30 is accommodated, and a second temperature sensor 106 that detects an air temperature Ta inside the tub 20, i.e., a temperature of the inside of the washing machine 1 is installed in a predetermined position of an upper side of the tub 20.

Installation positions of the water level sensor 102, the first temperature sensor 104, and the second temperature sensor 106 are not limited thereto, and they may be installed in any position in which sensor data required to control a locking or unlocking operation of the auxiliary door 60 can be detected.

Figure 9:
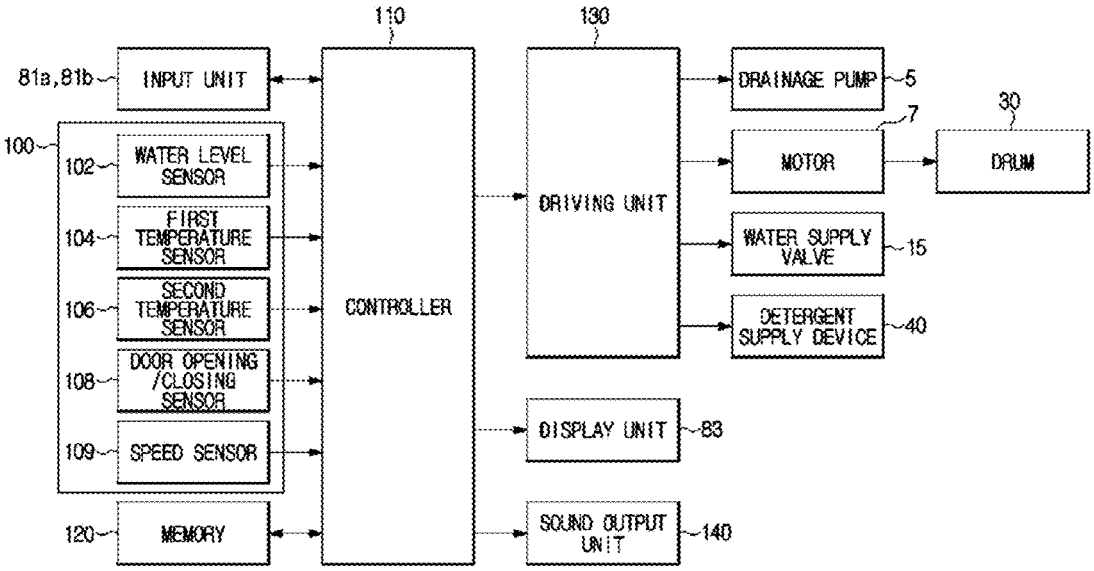
FIG. 9 is a control configuration view of the washing machine according to an embodiment of the present invention.

FIG. 9 is a control configuration view of the washing machine according to an embodiment of the present invention.

Referring to FIG. 9, the washing machine 1 according to an embodiment of the present invention includes the input units 81*a* and 81*b*, the display unit 83, a detector 100, the controller 110, a memory 120, a driving unit 130, and a sound output unit 140.

The input units 81*a* and 81*b* through which instructions for performing a washing cycle, a rinsing cycle and a dehydration cycle of the washing machine 1 by the user's manipulation are input, may be keys, buttons, switches, or touch pads and include all devices that generate predetermined input data by manipulation such as pressing, touch, pressure, rotation, or the like.

Also, the input units 81*a* and 81*b* are disposed on the control panel 80 and include a plurality of buttons (power, reservation, temperature of washing water, soaking, washing, rinsing, dehydration, a selection level, and the like) through which the user's instructions relating to the operation of the washing machine 1 are input. The plurality of buttons include a course selection button for selecting a washing course from a plurality of washing courses including a standard course, a wool course, a steaming course, a drying course, and the like according to the type of the laundry to be put into the washing machine 1.

The display unit 83 displays the operating state of the washing machine 1 according to a display control signal of the controller 110 and recognizes operation information input through the input units 81*a* and 81*b* to display the user's manipulation state.

Also, the display unit 83 may display a locked state of the auxiliary door 60 to check the locked state of the auxiliary door 60 when the user wants to open the auxiliary door 60 during the operation of the washing machine 1. To this end, the display unit 83 displays the locked state of the auxiliary door 60 as a text through the display unit 83, or the display unit 83 is turned on in such a way that the user can easily check the locked state of the auxiliary door 60.

In this way, the display unit 83 that is an LCD user interface (UI) on which an icon or a text can be written, displays the operating state (for example, a locked state of the auxiliary door) of the washing machine 1 so that the user can take a proper action.

Also, the display unit 83 that is an LED UI displays the operating state (for example, a locked state of the auxiliary door) of the washing machine 1 using turn on or off and a difference in duration time so that the user can easily check the state of the washing machine 1.

The display unit 83 may be configured so that the user does not open the auxiliary door 60 by force on locking conditions of the auxiliary door 60.

The detector 100 includes the water level sensor 102 that is installed inside the lower side of the tub 20 and detects the amount (level) of water in the tub 20, the first temperature sensor 104 that is installed inside the lower side of the tub 20 and detects the water temperature Tw of water in the tub 20, the second temperature sensor 106 that is installed in a predetermined position of the upper side of the tub 20 and detects an air temperature of the inside of the tub 20, i.e., a temperature of the inside of the washing machine, the door opening/closing sensor 108 that detects whether the auxiliary door 60 is opened/closed, and a speed sensor 109 that measures a rotation speed of the motor 7 to detect high-speed rotation of the drum 30, which are various sensors installed in the washing machine 1 so as to detect the level of water in the tub 20, the water temperature Tw, the air temperature Ta, and high-speed rotation of the drum 30 for a safe operation of the auxiliary door 60.

Meanwhile, in an embodiment of the present invention, the rotation speed of the motor 7 is measured such that high-speed rotation of the drum 30 can be detected. However, embodiments of the present invention are not limited thereto, and even though a current that flows through the motor 7 and a voltage applied to the motor 7 are measured so that high-speed rotation of the drum 30 is detected, of course, the same objectives and effects as those of the present invention can be achieved.

The controller 110 that is a microcomputer for controlling an overall operation of the washing machine 1, such as a washing cycle, a rinsing cycle and a dehydration cycle, according to the operation information input from the input units 81*a* and 81*b* sets a washing amount (target washing level) and a rinsing amount (target rinsing level), target revolutions per minute (RPM), a motor operation rate (washing motor on-off time), a washing time and the number of times being rinsed according to the weight (load amount) of the laundry in the selected washing course.

Also, the controller 110 provides an algorithm for safely and conveniently performing a locking/unlocking operation of the auxiliary door 60 through which the laundry can be additionally put into the washing machine 1 during the operation of the washing machine 1.

This will now be described in more detail.

When power is applied to the washing machine 1 and an operation starts being performed, the controller 110 detects opening/closing of the auxiliary door 60. When the auxiliary door 60 is opened, the controller 110 restricts the operation of the washing machine 1, and when the auxiliary door 60 is closed, the controller 110 attempts to perform the locking operation of the auxiliary door 60 using the auxiliary locking device 150.

When the auxiliary door 60 is actually closed, the locking protrusion 152 provided in the auxiliary locking device 150 protrudes and is inserted into the locking groove 151 formed in the auxiliary door 60 so that the auxiliary door 60 is locked and the cycle of the washing machine 1 can be normally performed.

Subsequently, the controller 110 determines whether the auxiliary door 60 is locked or not. A method of determining whether the auxiliary door 60 is locked or not may be performed by checking whether a motor (not shown, provided inside the auxiliary locking device) for protruding the locking protrusion 152 in the auxiliary locking device 150 is driven or not.

As a result of determination, when the auxiliary door 60 is not locked, the operation of the washing machine 1 is restricted, and when the auxiliary door 60 is locked, after locking of the auxiliary door 60 is maintained for a first time (time required to determine whether the auxiliary door is safely locked to start the operation of the washing machine, about 3 seconds), the auxiliary door 60 is unlocked. This is to maximize use convenience during the operation of the washing machine 1 that is an original purpose of the auxiliary door 60. Only by opening the auxiliary door 60 by unlocking the auxiliary door 60 by default, pause of the operation of the washing machine 1 and adding of the laundry can be performed so that the user can use the auxiliary door 60 conveniently.

Thus, the auxiliary door 60 is maintained in the locked state when the operation of the washing machine 1 starts and is changed into the unlocked state after the first time so that the operation of the washing machine 1 can be performed.

In this way, while the operation of the washing machine 1 is performed in a state in which the auxiliary door 60 is in the unlocked state, locking conditions of the auxiliary door 60 are generated. The locking conditions of the auxiliary door 60 may be determined by checking the level of water accommodated in the tub 20, the temperature (water temperature Tw) of water accommodated in the tub 20, the temperature (temperature inside the washing machine Ta) of air that flows inside the tub 20, high-speed rotation of the drum 30 (a dehydration section), the amount (weight that exceeds the specification) of the laundry, and the like. The locking conditions of the auxiliary door 60 during the operation of the washing machine 1 are determined because the user should be able to use the auxiliary door 60 not only conveniently but also safely.

The locking conditions of the auxiliary door 60 will be described in detail with reference to FIGS. 10 through 12.

That is, the controller 110 controls the auxiliary locking device 150 to lock the auxiliary door 60 when the level of water in the tub 20 is higher than a set water level (an overflow level at which water inside the tub may flow outwards), the temperature Tw of water accommodated in the tub 20 is higher than a set temperature Tws (a proper temperature at which the risk of a safety accident can be prevented, about 55° C.), the temperature Ta of air that flows inside the tub 20 is higher than a set temperature Tas (a proper temperature at which the risk of a safety accident can be prevented, about 65° C.), dehydration RPM P is higher than a set RPM Ps (proper RPM at which the risk of a safety accident can be prevented, about 60 to 200 rpm or more) and the weight L is more than a maximum weight Ls so that the auxiliary door 60 can be safely used.

Also, when the auxiliary door 60 is opened, if it is determined that water is insufficient according to the amount (weight) of the laundry to be added, the controller 110 may configure an algorithm to perform additional supply of water and an increase in time to guarantee a washing performance of the added laundry.

Also, when the auxiliary door 60 is opened, since there is a possibility that the laundry may be added or reduced, the controller 110 may configure an algorithm to initialize a weight detection value with respect to the laundry and to reset the weight detection value.

Meanwhile, in an embodiment of the present invention, the locking conditions of the auxiliary door 60 are determined by detecting the level of water accommodated in the tub 20, the temperature of water Tw, the temperature Ta of air that flows in the tub 20, high-speed rotation of the drum 30 and the weight of the laundry. However, embodiments of the present invention are not limited thereto, and it is obvious to configure the auxiliary door 60 to be locked even when an electronic component such as a temperature sensor has broken down and another error of a system is detected to restrict an additional operation. In addition, even when the washing machine 1 needs to operate without the laundry (weight set to zero, tub drying, tub washing course, or the like), the auxiliary door 60 is configured to be locked.

Setting information such as control data for controlling the operation of the washing machine 1, reference data used during control of the operation of the washing machine 1, operation data generated while the washing machine 1 performs a predetermined operation, and set data input by the input units 81*a* and 81*b* so that the washing machine 1 performs a predetermined operation, use information including the number of times at which the washing machine 1 performs a predetermined operation, and information about a model of the washing machine 1, and failure information including a malfunction cause or malfunction location when malfunction of the washing machine 1 occurs, may be stored in the memory 120.

Also, a control value for a temperature inside the drum 30 and a control value for the level of water in the tub 20 according to additional putting conditions of the laundry determined by the controller 110 may be stored in the memory 120, and a control program for controlling the washing machine 1 and a program such as an exclusive-use application firstly provided by a manufacturer or a general-use application downloaded from the outside may be stored in the memory 120.

In addition, the memory 120 may be implemented with a read only memory (ROM), a programmable read only memory (PROM), an erasable programmed read only memory (EPRM), a non-volatile memory device such as a flash memory, a volatile memory device such as a random access memory (RAM), or a storage device such as a hard disk or an optical disk. However, the memory 120 is not limited thereto, and various storage devices that may be considered by a designer may be used.

The driving unit 130 drives the drainage pump 5, the motor 7, the water supply valve 15, and the detergent supply unit 40 relating to the operation of the washing machine 1 according to a driving control signal of the controller 110.

The sound output unit 140 may include a speaker that outputs the operating state of the washing machine 1 and the user's manipulation state as a sound (for example, a beep sound) according to a sound control signal of the controller 110. In addition, the sound output unit 140 may further include a digital-to-analog convertor (DAC) that converts a digitalized electrical signal into an analog signal, and an amplifier that amplifies the electrical signal converted into the analog signal by the DAC.

Hereinafter, an operating procedure and effects of the washing machine including the auxiliary door 60 according to an embodiment of the present invention and a method of controlling the same will be described.

Figure 10:
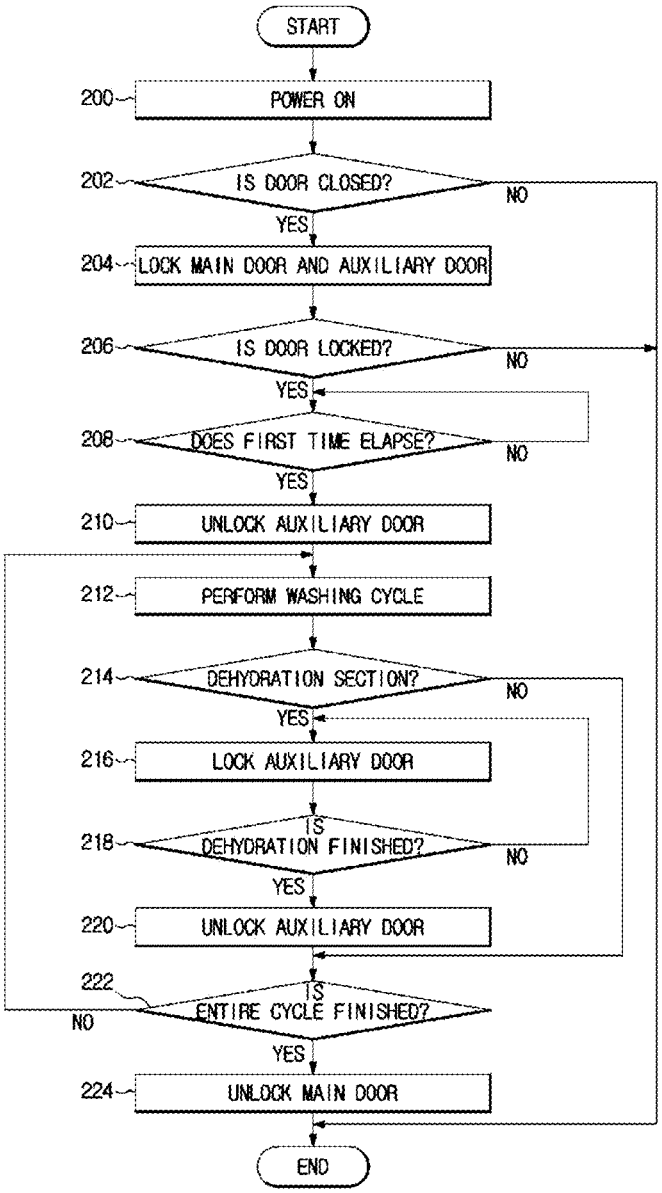
FIG. 10 is an operation flowchart of a first control algorithm for a locking operation of the auxiliary door in the washing machine according to an embodiment of the present invention.

FIG. 10 is an operation flowchart of a first control algorithm for a locking operation of the auxiliary door in the washing machine according to an embodiment of the present invention.

Referring to FIG. 10 that illustrates an algorithm for safely operating the auxiliary door 60 separately provided from the main door 70, a method of safely operating the auxiliary door 60 by determining conditions for locking the auxiliary door 60 during the operation of the washing machine 1 will be described.

In FIG. 10, after putting the laundry into the washing space 6 inside the drum 30 through the laundry port 2*a* by opening the main door 70 or the auxiliary door 60, the user closes the main door 70 or the auxiliary door 60 and selects a washing course from a plurality of washing courses including a standard course, a wool course, a delicate course, a steaming course, and the like, and a cycle. In this case, the operation information selected by the user is input to the controller 110 through the input units 81*a* and 81*b*.

In addition, the user may select a drying course including a drying cycle according to the type of the laundry by manipulating the input units 81*a* and 81*b*. In this case, the washing machine 1 is designed to perform the drying cycle after dehydration is finished, in line with a washing cycle.

When the washing course and cycle are selected and power is applied to the washing machine 1 (Operation 200), the controller 110 determines whether the auxiliary door 60 is closed using the door opening/closing sensor 108 (Operation 202).

In addition, the controller 110 may determine whether the main door 70 is closed, using a door opening/closing sensor (not shown) for detecting whether the main door 70 is opened/closed.

As a result of determination of Operation 202, if it is determined that the auxiliary door 60 or the main door 70 is opened, the controller 110 restricts the operation of the washing machine 1.

Meanwhile, as a result of determination of Operation 202, if it is determined that the auxiliary door 60 or the main door 70 is opened, the controller 110 attempts to perform a locking operation of the auxiliary door 60 using the auxiliary locking device 150 (Operation 204).

When the auxiliary door 60 is actually closed, the barrier 153 provided in the auxiliary locking device 150 is pressed by the locking groove 151 formed in the auxiliary door 60 and moves downwards and thus is inserted into the body 61 of the auxiliary door 60, and the locking protrusion 152 protrudes and is inserted into the locking groove 151 so that the auxiliary door 60 is locked (see FIG. 8).

In addition, the controller 110 may attempt to perform a locking operation of the main door 70 using the main locking device 72 installed in the front frame 10*b* of the main body 10.

When the main door 70 is actually closed, the locking device 71 formed in the main door 70 is inserted into the main locking device 72 formed in the front frame 10*b* of the main body 10 so that the main door 70 is locked.

In this way, when the auxiliary door 60 or the main door 70 is locked, the controller 110 determines whether the auxiliary door 60 is locked (Operation 206).

As a result of determination of Operation 206, if it is determined that the auxiliary door 60 is not locked, the controller 110 restricts the operation of the washing machine 1.

Meanwhile, as a result of determination of Operation 206, if it is determined that the auxiliary door 60 is locked, the controller 110 counts a time to determine whether the first time (time at which the auxiliary door is safely locked to start the operation of the washing machine, about 3 seconds) elapses (Operation 208).

As a result of determination of Operation 208, if the first time does not elapse, the controller 110 maintains locking of the auxiliary door 60 until the first time elapses.

Meanwhile, as a result of determination of Operation 208, if the first time does not elapse, the controller 110 inserts the protruding locking protrusion 152 into the auxiliary locking device 150 using the auxiliary locking device 150. Thus, the locking protrusion 152 is separated from the locking groove 151 so that the auxiliary door 60 is unlocked (Operation 210).

If the auxiliary door 60 is unlocked, the user opens the auxiliary door 60 freely so that use convenience that is an original purpose of the auxiliary door 60 can be maximized.

In this way, in a state in which the auxiliary door 60 is unlocked, the controller 110 starts to perform a series of cycles of the washing machine 1 according to the operation information input from the input units 81*a* and 81*b* (Operation 212). In this case, the controller 110 may display a state in which the auxiliary door 60 can be opened, as an icon or the like through the display unit 83.

Subsequently, the controller 110 determines whether a current section is a dehydration section while the cycle of the washing machine 1 is performed (Operation 214).

As a result of determination of Operation 214, if the current section is the dehydration section, the controller 110 protrudes the locking protrusion 152 inserted into the auxiliary locking device 150 using the auxiliary locking device 150. Thus, the locking protrusion 152 is inserted into the locking groove 151 so that the auxiliary door 60 is locked (Operation 216).

In this way, the auxiliary door 60 is locked in the dehydration section because, in the dehydration section, the drum 30 is rotated at high speed so that, when the user adds or removes the laundry through the auxiliary door 60, a dangerous situation may occur and thus this dangerous situation is prevented from occurring. The dehydration section in this case may include all of dehydration such as interim dehydration during pre-washing, interim dehydration during washing, and interim dehydration during rinsing in addition to final dehydration.

When dehydration is performed in a state in which the auxiliary door 60 is locked, the controller 110 determines whether the dehydration is finished (Operation 218).

As a result of determination of Operation 218, if the dehydration is not finished, the controller 110 goes back to Operation 216 and maintains the auxiliary door 60 in a locked state until the dehydration is finished.

Meanwhile, as a result of determination of Operation 218, if the dehydration is finished, the controller 110 inserts the protruding locking protrusion 152 into the auxiliary locking device 150 using the auxiliary locking device 150. Thus, the locking protrusion 152 is separated from the locking groove 151 so that the auxiliary door 60 is unlocked (Operation 220).

If the auxiliary door 60 is unlocked, the controller 110 performs the entire subsequent routine of the washing machine 1, i.e., a washing cycle, a rinsing cycle, and a dehydration cycle and determines whether the entire cycle of the washing machine 1 is finished (Operation 222).

Meanwhile, as a result of determination of Operation 214, if the current section is not the dehydration section, the controller 110 performs Operation 222 and performs the entire, subsequent cycle of the washing machine 1, i.e., the washing cycle, the rinsing cycle, and the dehydration cycle and determines whether the entire cycle of the washing machine 1 is finished.

As a result of determination of Operation 222, if the entire cycle is not finished, the controller 110 goes back to Operation 212 and continuously performs a subsequent cycle of the washing machine 1, i.e., the washing cycle, the rinsing cycle, and the dehydration cycle.

Meanwhile, as a result of determination of Operation 222, if the entire cycle is finished, the controller 110 unlocks the main door 70 to take out the laundry through the laundry port 2*a* (Operation 224).

In FIG. 10, while the cycle of the washing machine 1 is performed in a state in which the auxiliary door 60 is unlocked, an operation algorithm for locking the auxiliary door 60 in the dehydration section has been described. However, embodiments of the present invention are not limited thereto, and the auxiliary door 60 may be unlocked in all sections excluding the dehydration section only up to first rinsing or may be unlocked in all sections if necessary.

In addition, according to the present invention, the auxiliary door 60 may be unlocked in all sections excluding the dehydration section only up to first rinsing, and the auxiliary door 60 may also be locked after second rinsing.

Next, in order to more safely use the auxiliary door 60 while the cycle of the washing machine 1 is performed in a state in which the auxiliary door 60 is unlocked, several situations for conditions for locking the auxiliary door 60 will be described with reference to FIGS. 11A and 11B.

Figure 11A:
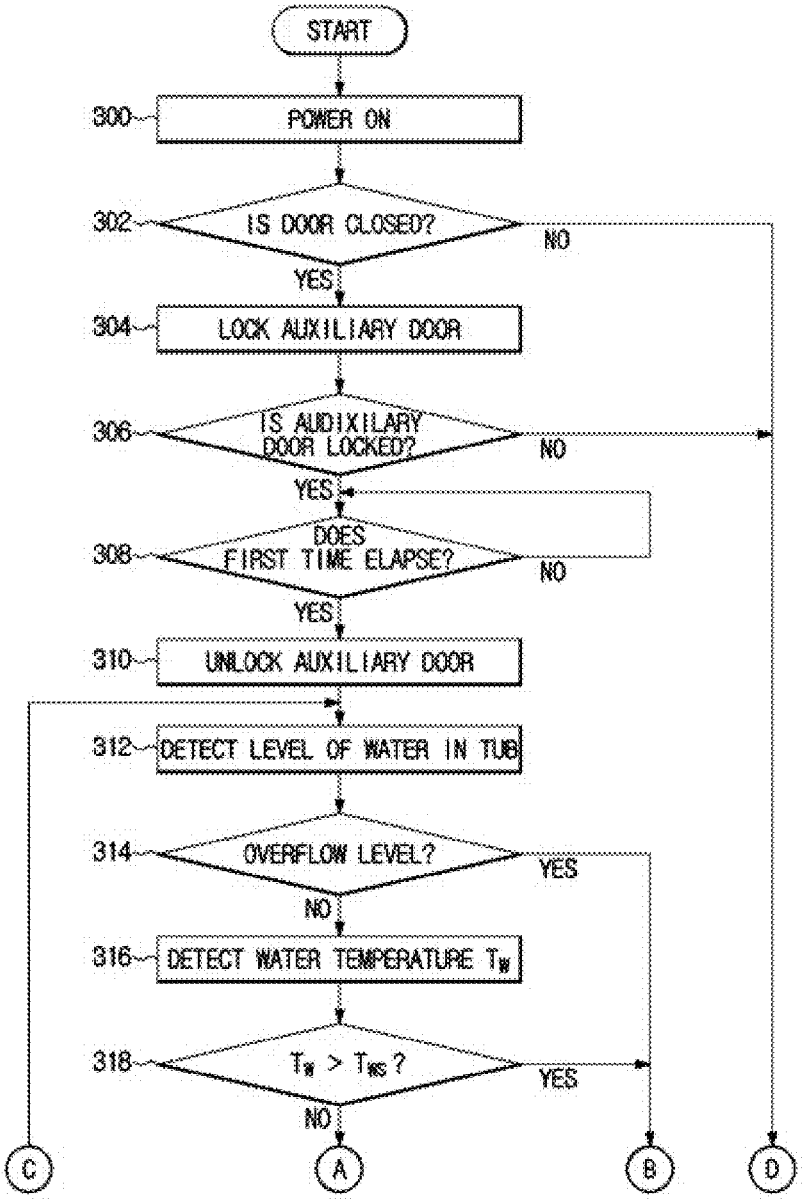
FIGS. 11A and 11B are operation flowcharts of a second control algorithm for a locking operation of the auxiliary door in the washing machine according to an embodiment of the present invention.
Figure 11B:
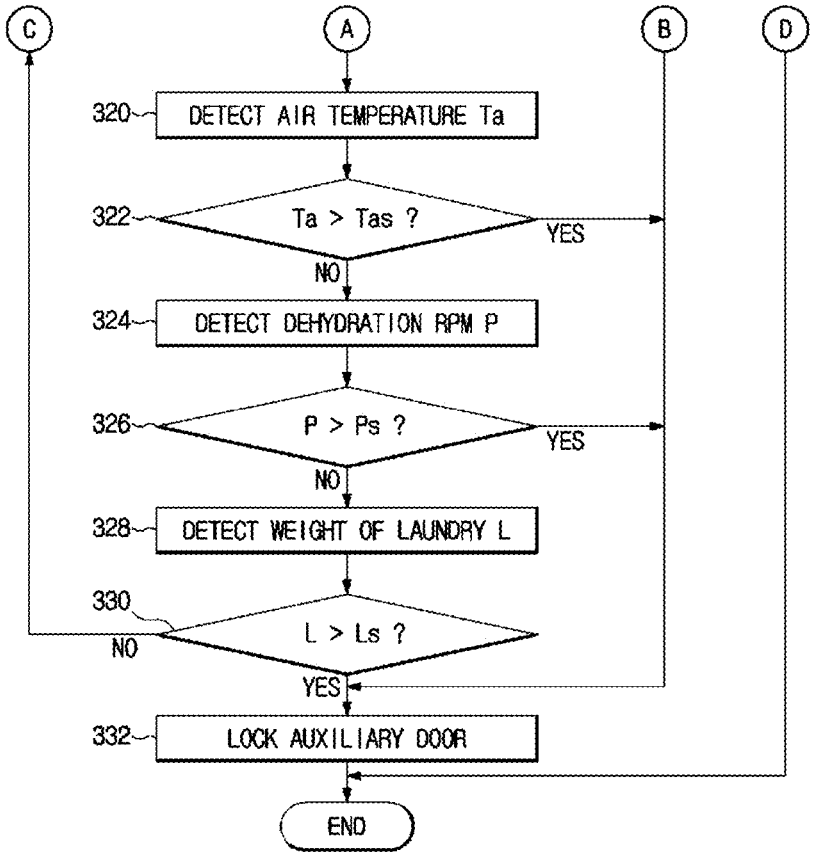

FIGS. 11A and 11B are operation flowcharts of a second control algorithm for a locking operation of the auxiliary door in the washing machine according to an embodiment of the present invention. Like names and like reference numerals are used for the same elements as those of FIG. 10, and a redundant description thereof will be omitted.

Referring to FIGS. 11A and 11B, after opening the main door 70 or the auxiliary door 60 and putting the laundry into the drum 30, the user closes the main door 70 or the auxiliary door 60 and selects a washing course and cycle.

If power is applied to the washing machine 1 (Operation 300), the controller 110 determines whether the auxiliary door 60 is closed using the door opening/closing sensor 108 (Operation 302).

As a result of determination of Operation 302, if it is determined that the auxiliary door 60 is opened, the controller 110 restricts the operation of the washing machine 1.

Meanwhile, as a result of determination of Operation S302, if it is determined that the auxiliary door 60 is opened, the controller 110 attempts to perform a locking operation of the auxiliary door 60 using the auxiliary locking device 150 (Operation 304).

When the auxiliary door 60 is actually closed, the barrier 153 provided in the auxiliary locking device 150 is pressed by the locking groove 151 formed in the auxiliary door 60 and moves downwards and is inserted into the body 61 of the auxiliary door 60, and the locking protrusion 152 protrudes and is inserted into the locking groove 151 so that the auxiliary door 60 is locked (see FIG. 8).

In this way, if the auxiliary door 60 is locked, the controller 110 determines whether the auxiliary door 60 is locked (Operation 306).

As a result of determination of Operation 306, if it is determined that the auxiliary door 60 is not locked, the controller 110 restricts the operation of the washing machine 1.

Meanwhile, as a result of determination of Operation 306, if it is determined that the auxiliary door 60 is locked, the controller 110 counts a time and determines whether the first time elapses (Operation 308).

As a result of determination of Operation 308, if the first time does not elapse, the controller 110 maintains locking of the auxiliary door 60 until the first time elapses.

Meanwhile, as a result of determination of Operation 308, if the first time does not elapse, the controller 110 inserts the protruding locking protrusion 152 into the auxiliary locking device 150 using the auxiliary locking device 150. Thus, the locking protrusion 152 is separated from the locking groove 151 so that the auxiliary door 60 is unlocked (Operation 310).

If the auxiliary door 60 is unlocked, the user opens the auxiliary door 60 freely so that use convenience that is an original purpose of the auxiliary door 60 can be maximized.

In this way, in a state in which the auxiliary door 60 is unlocked, the controller 110 performs a series of cycles of the washing machine 1 according to the operation information input from the input units 81*a* and 81*b*. In this case, the controller 110 may display a state in which the auxiliary door 60 can be opened, as an icon or the like through the display unit 83.

Subsequently, the controller 110 detects the level of water accommodated in the tub 20 while the cycle of the washing machine 1 is performed, using the water level sensor 102 (Operation 312) and determines whether the detected level of water in the tub 20 is an overflow level (Operation 314).

As a result of determination of Operation 314, if the level of water in the tub 20 is not the overflow level, the controller 110 detects the temperature (water temperature Tw) of water accommodated in the tub 20 using the first temperature sensor 104 (Operation 316) and determines whether the detected temperature Tw of water in the tub 20 is higher than the set temperature Tws (a proper temperature at which the risk of a safety accident can be prevented, about 55° C.) (Operation 318).

As a result of determination of Operation 318, if the temperature Tw of water accommodated in the tub 20 is not higher than the set temperature Tws, the controller 110 detects the temperature Ta of air that flows inside the tub 20 using the second temperature sensor 106 (Operation 320) and determines whether the detected air temperature Ta in the tub 20 is higher than the set temperature Tas (a proper temperature at which the risk of a safety accident can be prevented, about 65° C.)(Operation 322).

As a result of determination of Operation 322, if the air temperature Ta in the tub 20 is not higher than the set temperature Tas, the controller 110 detects the dehydration RPM P using the speed sensor 109 (Operation 324) and determines whether the detected dehydration RPM P is higher than the set RPM Ps (proper RPM at which the risk of a safety accident can be prevented, about 60 to 200 rpm or more)(Operation 326).

As a result of determination of Operation 326, if the dehydration RPM P is not higher than the set RPM Ps, the controller 110 drives the motor 7 so as to detect the weight of the laundry put into the drum 30. A method of detecting the weight of the laundry by driving the motor 7 may be any one among a method of detecting the weight of the laundry using time at which the motor 7 reaches a predetermined duty, and a value of angular velocity by rotating the motor 7 with weight detection RPM (about 70 to 150 RPM) and giving a predetermined duty (90V) to the motor 7, a method of detecting the weight of the laundry using time at which the motor 7 reaches a predetermined speed (or predetermined RPM) using instantaneous acceleration of the motor 7, and a method of detecting the weight of the laundry using the second law of motion (torque=inertia×acceleration) after directly or indirectly measuring the amount of inertia of the drum 30 by giving a torque to the motor 7 for a predetermined time, as disclosed in Japanese Patent Laid-open Publication No. 2002-336593, Japanese Patent Laid-open Publication No. 2004-267334, and Japanese Patent Publication No. H07-90077.

In addition, it is obvious that the weight of the laundry can be detected using a load cell among well-known methods.

When the weight of the laundry is detected (Operation 328), the controller 110 determines whether the detected weight L is larger than the maximum weight Ls (a predetermined weight or more)(Operation 330).

As a result of determination of Operation 330, if the detected weight L is not larger than the maximum weight Ls, the controller 110 goes back to Operation 312 and performs a subsequent operation.

Meanwhile, as a result of determination of Operation 330, if the detected weight L is larger than the maximum weight Ls, the controller 110 determines that the predetermined weight or more of the laundry is put into the drum 30 and protrudes the locking protrusion 152 inserted into the auxiliary locking device 150 using the auxiliary locking device 150. Accordingly, the locking protrusion 152 is inserted into the locking groove 151 so that the auxiliary door 60 is locked (Operation 332).

In this way, the auxiliary door 60 is locked when the weight of the laundry inside the drum 30 is a predetermined weight or more because, when the auxiliary door 60 is not easily closed, when the laundry cannot be added even though the auxiliary door 60 is opened, or in a weight at which the laundry is pushed outwards and there is no possibility that the auxiliary door 60 is opened, the auxiliary door 60 is locked so that the above-mentioned situation does not occur.

Meanwhile, as a result of determination of Operation 314, if the level of water inside the tub 20 is the overflow level, the controller 110 performs Operation 332, protrudes the locking protrusion 152 inserted into the auxiliary locking device 150, and inserts the locking protrusion 152 into the locking groove 151 so that the auxiliary door 60 is locked. This is to prevent water accommodated in the tub 20 from overflowing when the auxiliary door 60 is opened and the laundry is additionally put.

Meanwhile, as a result of determination of Operation 318, if the temperature Tw of water accommodated in the tub 20 is higher than the set temperature Tws, the controller 110 performs Operation 332, protrudes the locking protrusion 152 inserted into the auxiliary locking device 150, and inserts the locking protrusion 152 into the locking groove 151 so that the auxiliary door 60 is locked. This is to remove the risk of a safety accident like a burn caused by high-temperature water inside the tub 20 when the auxiliary door 60 is opened and the laundry is additionally put.

Meanwhile, as a result of determination of Operation 322, if the air temperature Ta inside the tub 20 is higher than the set temperature Tas, the controller 110 performs Operation 332, protrudes the locking protrusion 152 inserted into the auxiliary locking device 150, and inserts the locking protrusion 152 into the locking groove 151 so that the auxiliary door 60 is locked. This is to remove the risk of a safety accident like a burn caused by high-temperature air inside the tub 20 when the auxiliary door 60 is opened and the laundry is additionally put.

Meanwhile, as a result of determination of Operation 326, if it is determined that the dehydration RPM P is higher than the set RPM Ps, the controller 110 performs Operation 332, protrudes the locking protrusion 152 inserted into the auxiliary locking device 150, and inserts the locking protrusion 152 into the locking groove 151 so that the auxiliary door 60 is locked. This is to remove the risk of a safety accident like injury caused by high-speed rotation of the drum 30 when the auxiliary door 60 is opened and the laundry is additionally put.

In FIGS. 11A and 11B, an algorithm for detecting the level of water accommodated in the tub 20, the temperature Tw of water, the temperature Ta of air that flows inside the tub 20, high-speed rotation of the drum 30 and the weight of the laundry and determining whether the auxiliary door 60 is on locking conditions has been described. However, embodiments of the present invention are not limited thereto, and even when an electronic component such as a temperature sensor has broken down and another error of the system is detected to restrict an additional operation, an algorithm for determining the locking conditions of the auxiliary door 60 so that the auxiliary door 60 is locked, may also be implemented.

Next, an algorithm for determining a change of weight of the laundry and controlling supply of water and time when the auxiliary door 60 is opened and the laundry is added, will be described with reference to FIG. 12.

Figure 12:
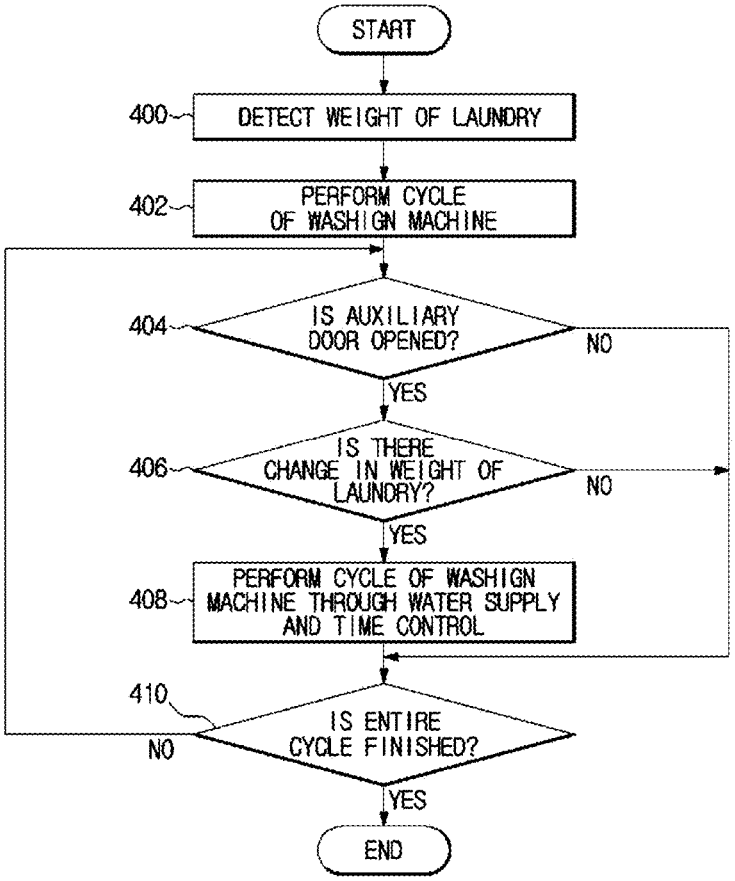
FIG. 12 is an operation flowchart of a control algorithm of a cycle profile in the washing machine according to an embodiment of the present invention.

FIG. 12 is an operation flowchart of a control algorithm of a cycle profile in the washing machine according to an embodiment of the present invention.

Referring to FIG. 12, when the user puts the laundry into the drum 30 and inputs operation information relating to a washing course and the operation of the washing machine 1 according to the type of the laundry, the operation information selected by the user is input to the controller 110 through the input units 81*a* and 81*b*.

Thus, the controller 110 drives the motor 7 so as to detect the weight of the laundry put into the drum 30. A method of detecting the weight of the laundry by driving the motor 7 may be any one among a method of detecting the weight of the laundry using time at which the motor 7 reaches a predetermined duty, and a value of angular velocity by rotating the motor 7 with weight detection RPM (about 70 to 150 RPM) and giving a predetermined duty (90V) to the motor 7, a method of detecting the weight of the laundry using time at which the motor 7 reaches a predetermined speed (or predetermined RPM) using instantaneous acceleration of the motor 7, and a method of detecting the weight of the laundry using the second law of motion (torque=inertia×acceleration) after directly or indirectly measuring the amount of inertia of the drum 30 by giving a torque to the motor 7 for a predetermined time, as disclosed in Japanese Patent Laid-open Publication No. 2002-336593, Japanese Patent Laid-open Publication No. 2004-267334, and Japanese Patent Publication No. H07-90077.

In addition, it is obvious that the weight of the laundry can be detected using a load cell among well-known methods.

When the weight of the laundry is detected (Operation 400), the controller 110 sets motor RPM and an operation rate (a motor on-off time), a target washing level and a target rising level, a washing time and the number of times being rinsed according to the detected weight of the laundry.

Setting the motor RPM and the operation rate (the motor on-off time), the target washing level and the target rising level, the washing time and the number of times being rinsed according to the weight of the laundry corresponds to a case in which the user does not input additional instructions relating to the operation of the washing machine 1. When the user additionally inputs the additional instructions relating to the operation of the washing machine 1, the motor RPM and the operation rate (the motor on-off time), the target washing level and the target rising level, the washing time and the number of times being rinsed set according to the weight of the laundry may be changed according to the user's instructions.

Subsequently, the controller 110 starts to perform a series of cycles of the washing machine 1 according to the set operation information (Operation 402).

While the cycle of the washing machine 1 is performed, the controller 110 determines whether the auxiliary door 60 is opened, through the door opening/closing sensor 108 (Operation 404).

As a result of determination of Operation 404, if the auxiliary door 60 is opened, there is a possibility that the laundry may be added or reduced. Thus, the controller 110 detects the weight of the laundry and determines whether there is a change in the weight of the laundry (Operation 406).

As a result of determination of Operation 406, if there is a change in the weight of the laundry, the controller 110 performs the entire, subsequent cycle of the washing machine 1, i.e., a washing cycle, a rinsing cycle, and a dehydration cycle, for guaranteeing a washing performance of the added laundry through additional supply of water and an increase in time according to the change in the weight of the laundry (Operation 408).

Subsequently, the controller 110 determines whether the entire cycle of the washing machine 1 is finished (Operation 410), and if the entire cycle is not finished, the controller 110 goes back to Operation 404, determines whether the auxiliary door 60 is opened, and performs a subsequent operation.

As a result of determination of Operation 410, if the entire cycle is finished, the controller 110 terminates all operations of the washing machine 1.

In FIG. 12, when the laundry is additionally put through the auxiliary door 60, a cycle profile has been changed to guarantee the washing performance. However, embodiments of the present invention are not limited thereto, and the cycle profile may be changed to guarantee a degree of dehydration.

In addition, in an embodiment of the present invention, the laundry is additionally put through the auxiliary door 60. However, an object to be put through the auxiliary door 60 is not limited to the laundry, and even when a detergent or fabric softener is put, of course, the same objectives and effects as those of the present invention can be achieved.

The above, detailed description is illustrative of the present invention. In addition, the above-described contents are to explain exemplary embodiments of the present invention, and the present invention can be used in other various combinations, changes, and environments. That is, the present invention may be changed or modified within the scope of the concept of the invention disclosed in the present specification, an equivalent scope to the described disclosure, and/or the scope of technology or knowledge in the art. The embodiments are illustrative of a best state for implementing a technical spirit of the present invention, and various modifications required in a detailed application field and purpose of the present invention are possible. Thus, the above, detailed description of the invention is not to be construed as limited to the specific embodiments disclosed. Also, the attached claims should be interpreted to include other embodiments.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A washing machine comprising:

a main body configured to constitute an exterior of the washing machine and has a laundry port therein;

a main door provided on the main body to open and close the laundry port;

an auxiliary door provided on the main door and capable of being opened and closed separately from the main door;

a first locking device provided on the main body; and a second locking device provided on the main door and comprising a locking protrusion installed to be insertable into the auxiliary door and a motor configured to move the locking protrusion.

2. The washing machine of claim 1, further comprising:

a controller configured to control the first locking device to lock or unlock the main door and control the motor of the second locking device to lock or unlock the auxiliary door.

3. The washing machine of claim 2, further comprising:

a locking groove provided on the auxiliary door, wherein the controller is further configured to control the second locking device to project the locking protrusion into the locking groove.

4. The washing machine of claim 3, wherein the controller is further configured to control the motor of the second locking device based on a state in which the auxiliary door is closed.

5. The washing machine of claim 1, further comprising:

a door opening and closing sensor is provided on one side of the main door configured to detect opening and closing of the auxiliary door.

6. The washing machine of claim 5, further comprising:

a controller configured to determine a state in which the auxiliary door is closed based on a detection of the door opening and closing sensor, and control the second locking device in the state in which the auxiliary door is closed.

7. The washing machine of claim 1, further comprising:

a barrier configured to prevent protrusion of the locking protrusion depending on opening and closing of the auxiliary door.

8. The washing machine of claim 7, wherein the barrier is configured to:

prevent projection of the locking protrusion when the auxiliary door is open; and move downward when the auxiliary door is closed.

9. The washing machine of claim 8, further comprising:

a locking groove provided on the auxiliary door, wherein the locking groove is configured to move the barrier downwards when the auxiliary door is closed.

10. The washing machine of claim 7, wherein the barrier is inserted in the main body when moved downwards.

11. The washing machine of claim 1, wherein:

a first side of the auxiliary door is hinge-coupled to the main door, and the second locking device is provided on a second side of the auxiliary door.

12. The washing machine of claim 2, wherein:

the controller is further configured to start an operation of the washing machine after determining the locking of the auxiliary door.

13. The washing machine of claim 2, wherein:

a first side of the main door is hinged coupled to the main body and a locking portion is formed at a second side of main door, and the controller is further configured to control the first locking device to lock the main door when the locking portion is inserted into the first locking device.

14. The washing machine of claim 2, further comprising:

a tub installed inside the main body and configured to accommodate water; and a drum rotatably installed inside the tub and configured to accommodate laundry, wherein the controller is further configured to:

maintain the auxiliary door in an unlocked state during an operation of the washing machine, and when locking conditions of the auxiliary door are detected by a detector, control a locking operation of the auxiliary door.

15. The washing machine of claim 14, wherein:

the detector comprises a water level sensor configured to detect a level of water accommodated in the tub, and the controller is further configured to control the second locking device when the detected level of water is an overflow level.

16. The washing machine of claim 14, wherein:

the detector comprises a speed sensor configured to detect dehydration revolutions per minute (RPM) of the drum, and the controller is further configured to control the second locking device when the detected dehydration RPM is higher than a set RPM.

17. The washing machine of claim 14, wherein:

the detector comprises a temperature sensor configured to detect a temperature of water or an air accommodated in the tub, and the controller is further configured to control the second locking device based on the detected temperature.

* * * * *